US010228178B2

(12) United States Patent
Yang

(10) Patent No.: US 10,228,178 B2
(45) Date of Patent: Mar. 12, 2019

(54) ICE MAKER OF REFRIGERATOR AND METHOD OF MANUFACTURING THE SAME

(71) Applicant: Dongbu Daewoo Electronics Corporation, Seoul (KR)

(72) Inventor: Sung Jin Yang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 537 days.

(21) Appl. No.: 14/835,607

(22) Filed: Aug. 25, 2015

(65) Prior Publication Data

US 2016/0370075 A1 Dec. 22, 2016

(30) Foreign Application Priority Data

Jun. 18, 2015 (KR) ..... 10-2015-0086320

(51) Int. Cl.

| | |
|---|---|
| ***F25C 5/20*** | (2018.01) |
| ***F25C 5/08*** | (2006.01) |
| ***F25C 1/24*** | (2018.01) |
| ***F25C 5/182*** | (2018.01) |

(52) U.S. Cl.

CPC ..... *F25C 5/08* (2013.01); *F25C 1/24* (2013.01); *F25C 5/182* (2013.01); *F25C 5/22* (2018.01); *F25D 2317/061* (2013.01)

(58) Field of Classification Search

CPC ..... F25C 1/04; F25C 1/22–1/246

See application file for complete search history.

(56) References Cited

U.S. PATENT DOCUMENTS

| | | | |
|---|---|---|---|
| 2008/0034780 | A1 | 2/2008 | Lim et al. |
| 2011/0162406 | A1 | 7/2011 | Shin et al. |
| 2012/0279240 | A1 | 11/2012 | Jeong et al. |
| 2013/0167569 | A1 | 7/2013 | Lee |
| 2015/0316306 | A1 | 11/2015 | Ji et al. |

FOREIGN PATENT DOCUMENTS

| | | | |
|---|---|---|---|
| KR | 10-2005-0022967 | A | 3/2005 |
| KR | 10-2008-0015340 | | 2/2008 |
| KR | 10-2012-0124324 | A | 11/2012 |
| KR | 10-1320767 | | 10/2013 |
| KR | 10-2014-0074795 | A | 6/2014 |

OTHER PUBLICATIONS

Extended European Search Report dated Nov. 16, 2016 issued in corresponding European Patent Application No. 15187263.7.

*Primary Examiner* — Jianying Atkisson
*Assistant Examiner* — Antonio R Febles

(57) ABSTRACT

An ice maker of a refrigerator includes a cooling unit for generating cold air; a case mounted in a food storage space, and defining a cooling space for receiving the cold air; an ice making assembly for making ice; and a bucket arranged at one side of the ice making assembly for receiving the ice. The ice making assembly includes an ice tray arranged in the cooling space, the ice tray having an ice making recess formed in an upper surface thereof for making ice; and a cold air guiding unit arranged at a lower side of the ice tray for guiding the cold air to the lower side of the ice tray, and a heater provided at the lower side of the ice tray such that the heater is spatially separated from the cold air guiding unit, and is configured for emitting heat to separate ice from the ice making recess.

6 Claims, 5 Drawing Sheets

ICE MAKER OF REFRIGERATOR AND METHOD OF MANUFACTURING THE SAME

CROSS-REFERENCE TO RELATED APPLICATIONS

The present application claims priority to and the benefit of the Republic of Korea Patent Application Serial Number 10-2015-0086320, having a filing date of Jun. 18, 2015, filed in the Korean Intellectual Property Office, the disclosure of which is herein incorporated by reference in its entirety.

FIELD OF THE INVENTION

The present invention relates to an ice maker of a refrigerator and a manufacturing method of the same.

BACKGROUND

A refrigerator unit is an apparatus that functions to store food at low temperatures. The refrigerator unit may store foods in a frozen or refrigerated state according to the type of food intended to be stored The interior of the refrigerator is cooled by cold air that is continuously supplied to the refrigerator unit. The cold air is continuously generated through heat exchanging between air and a refrigerant performed in a refrigeration cycle including a compression-condensation-expansion-evaporation process. The cold air supplied into the refrigerator is evenly transferred to the interior of the refrigerator by convection, so that the cold air can store food, drink, and other items within the refrigerator unit at desired temperatures.

The main body of a refrigerator unit typically has a rectangular, hexahedral shape which is open at the front surface thereof. The main body may have a refrigeration chamber and a freezer chamber defined therein. Further, hinged doors may be fitted to the front surface of the main body selectively open and/or close openings to the refrigeration chamber and the freezer chamber. In addition, the storage space defined inside the refrigeration chamber and the freezer chamber of the refrigerator unit may include a plurality of drawers, shelves, and storage boxes, etc. that are configured for optimally storing various kinds of foods, drinks, and other items.

Conventionally, refrigerator units were configured as a top-mount type refrigerator, in which a freezer chamber is positioned in the upper part of the main body, and the refrigeration chamber is positioned in the lower part of the main body. In recent years, to enhance user convenience bottom-freezer type refrigerators position the freezer chamber below the refrigeration chamber. In the bottom-freezer type refrigerator, the more frequently used refrigeration chamber is advantageously positioned in the upper part of the main body so that a user may conveniently access the refrigeration compartment without bending over at the waist, as previously required by the top-mount refrigerator. The less frequently used freezer chamber is positioned in the lower part of the main body.

However, a bottom-freezer type refrigerator, in which the freezer chamber is provided in the lower part, may lose its design benefits when a user wants to access the lower freezer chamber more frequently than anticipated, such as to take ice cubes. In a bottom-freezer type refrigerator, the user would have to bend over at the waist in order to open the freezer chamber door and access the ice cubes.

In order to solve this problem, bottom-freezer type refrigerators may include an ice dispenser for dispensing ice cubes that is provided in a refrigeration chamber door. In this case, the ice dispenser is also placed in the upper part of a bottom-freezer type refrigerator, and more specifically is located above the freezer chamber. In this refrigerator unit, an ice maker for making ice cubes may be provided in the refrigeration chamber door, in the interior of the refrigeration chamber.

The ice maker may include an ice making assembly having an ice tray which makes ice (e.g., ice cubes), an ice bucket which stores the ice, and a transfer assembly for transferring the ice stored in the bucket to the dispenser.

The ice making assembly may include a heater. The heater may emit heat for separating the ice from the ice making assembly. Specifically, ice making recesses may be formed in an upper surface of the tray, and water stored in the recesses is frozen into ice. The heater may emit heat to slightly melt the ice, such that the ice can be easily separated from the ice making recesses.

However, the heat emitted by the heater interacts with cold air that is supplied to the tray, and a heat exchange between the heat and the cold air is performed, which reduces the cold air available for freezing water to ice. As a result, both the cooling efficiency and the ice separation efficiency are lowered.

In addition, the tray may be provided with a bottom surface thereof including a plurality of cooling ribs extending in a longitudinal direction of the tray. The cooling ribs increase the contact area between the tray and the cold air.

What is needed is an efficient way to make ice within a refrigerator unit.

SUMMARY

In view of the above, therefore, embodiments of the present invention provide an ice maker of a refrigerator unit that is capable of limiting and/or preventing the heat exchange between heat emitted by a heater and cold air used to make ice, thereby improving overall efficiency of an ice maker, and a manufacturing method of the same.

It is another object of embodiments of the present invention to provide an ice maker of a refrigerator unit including cooling ribs to which the shape, structure, arrangement, etc. are designed and changed from the prior art to improve cooling efficiency, and a manufacturing method of the same.

According to an embodiment of the present invention, an ice maker of a refrigerator unit. The ice maker may include a cooling unit for generating cold air, and a case mounted in a food storage space of the refrigerator unit and/or a door for shielding the food storage space. The case having defined therein a cooling space for receiving the cold air generated by the cooling unit; an ice making assembly for making ice using the cold air; and a bucket arranged at one side of the ice making assembly in the cooling space for receiving the ice separated from the ice making assembly. The ice making assembly includes an ice tray arranged in the cooling space, the ice tray having a plurality of ice making recesses formed in an upper surface thereof for making ice; a cold air guiding unit arranged at a lower side of the ice tray for guiding the cold air supplied from the cooling unit to the lower side of the ice tray; and a heater provided at the lower side of the ice tray, such that the heater is configured to be spatially separated from the cold air guiding unit, and is configured for emitting heat to separate the ice from the ice making recesses.

Also in one embodiment, the heater is provided along an edge of the ice tray, and the cold air flows along a central portion of the ice tray in a longitudinal direction of the ice tray.

Further, the heater is provided along an edge of the tray. The ice maker includes a first heat exchange prevention wall protruding downward from a bottom surface of the ice tray, while extending along the edge of the ice tray. The first heat exchange prevention wall is located more inwardly in relation to the ice tray than the heater, and the cold air flows inside the first heat exchange prevention wall.

Further, the cold air guiding unit includes a guide member spaced apart downward from the bottom surface of the ice tray. The guide member is configured for defining a cold air flow channel, along which cold air flows between the guide member and the bottom surface of the ice tray.

Also, the ice maker further includes a pair of second heat exchange prevention walls protruding upward from an upper surface of the guide member, while extending along the edge of the ice tray in a longitudinal direction of the ice tray. The second heat exchange prevention walls may be spaced apart from each other in a lateral direction of the ice tray.

Further in one embodiment, the heater is located outside the second heat exchange prevention walls, and the cold air flows between the second heat exchange prevention walls.

Also in one embodiment, the first heat exchange prevention wall is adjacent to the second heat exchange prevention walls. At least a portion of the first heat exchange prevention wall and at least a portion of at least one of the second heat exchange prevention walls overlap each other in the lateral direction of the ice tray.

Further, the ice maker includes a plurality of cooling ribs protruding downward from a bottom surface of the ice tray, while extending in a longitudinal direction of the ice tray. Each of the cooling ribs is configured to include at least one curved section, wherein the cooling ribs are configured to be spaced apart from each other.

In accordance with another embodiment of the present invention, a method of manufacturing an ice maker of a refrigerator unit includes: preparing a case; arranging a cooling unit for generating cold air; arranging an ice tray having at least one ice making recess formed in an upper surface thereof for making ice; arranging a heater at a lower side of the tray; and arranging a cold air guiding unit for guiding the cold air generated by the cooling unit to the lower side of the ice tray, wherein the cold air guiding unit and the heater are spatially separated from each other at the lower side of the ice tray.

In still another embodiment, a refrigerator is disclosed, and includes: a freezer compartment located within a main body of the refrigerator; a refrigeration compartment located within the main body of the refrigerator, wherein the freezer compartment is located below the refrigeration compartment; and an ice maker for making ice cubes. The ice maker includes a cooling unit configured for generating cold air; a case mounted in a food storage space of the refrigerator or a door for shielding the food storage space, wherein the case defines a cooling space for receiving the cold air generated by the cooling unit; an ice making assembly for making ice; and a bucket arranged at one side of the ice making assembly for receiving the ice separated from the ice making assembly. The ice making assembly includes an ice tray arranged in the cooling space, the ice tray having an ice making recess formed in an upper surface thereof for making ice; a cold air guiding unit arranged at a lower side of the ice tray for guiding the cold air supplied from the cooling unit to the lower side of the ice tray; and a heater provided at the lower side of the ice tray, such that the heater is spatially separated from the cold air guiding unit, wherein the heater is configured for emitting heat to separate the ice from the ice making recess.

BRIEF DESCRIPTION OF THE DRAWINGS

The above and other objects, features, and other advantages of the present invention will be more clearly understood from the following detailed description of exemplary embodiments taken in conjunction with the accompanying drawings, which are incorporated in and form a part of this specification, and in which like number of depict like elements, in which.

DETAILED DESCRIPTION

Hereinafter, exemplary embodiments of the present invention will be described below in detail with reference to the accompanying drawings so that they can be readily implemented by those skilled in the art. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In certain embodiments, detailed descriptions of relevant constructions or functions well known in the art may be omitted to avoid obscuring appreciation of the disclosure.

Figure 1:
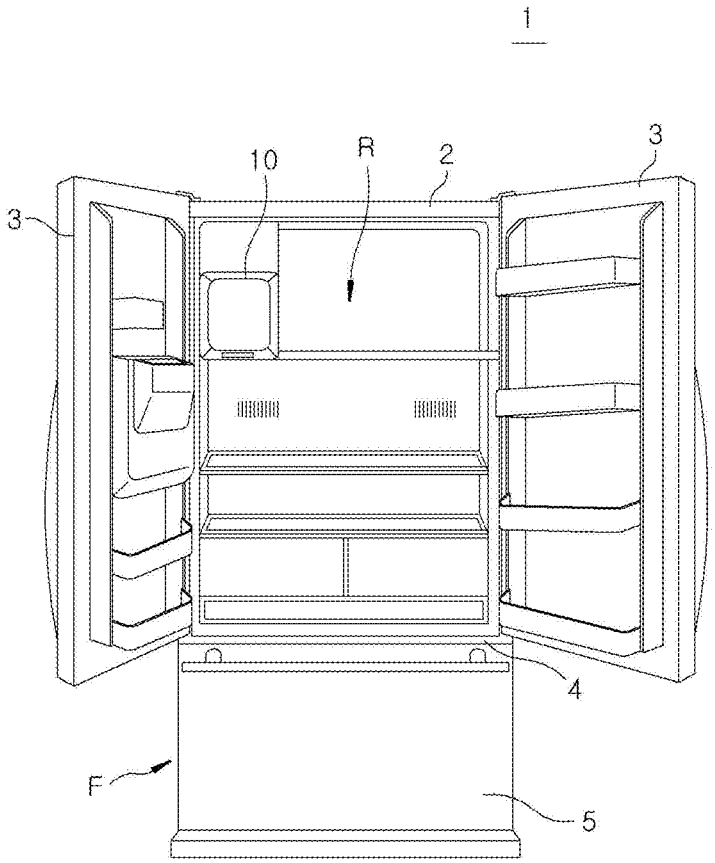
FIG. 1 is a diagram illustrating a refrigerator unit including an ice maker according to an embodiment of the present invention.
Figure 2:
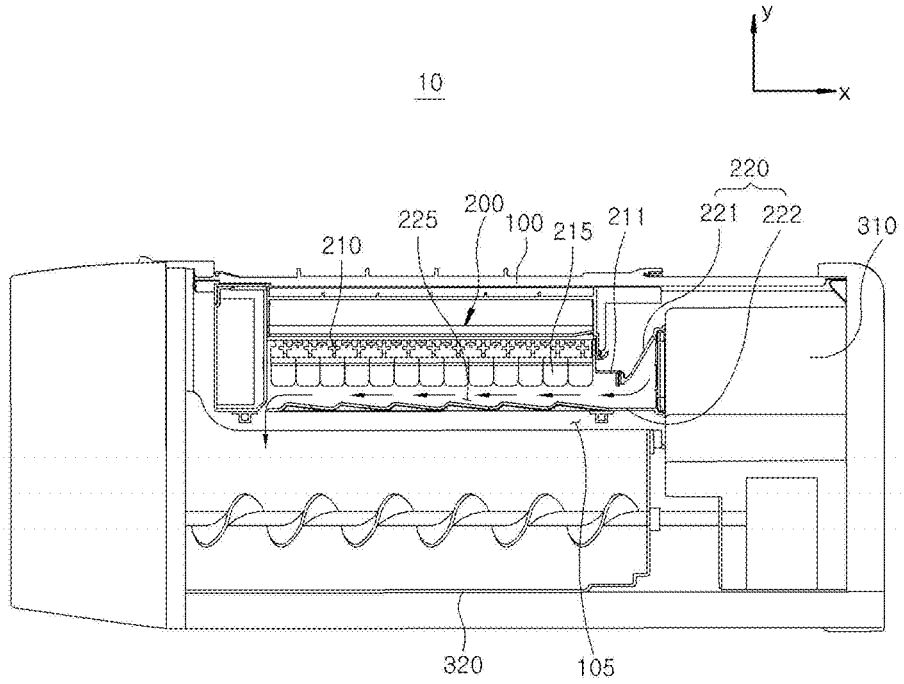
FIG. 2 is a side cross-sectional view showing the ice maker of FIG. 1 according to an embodiment of the present invention.
Figure 3:
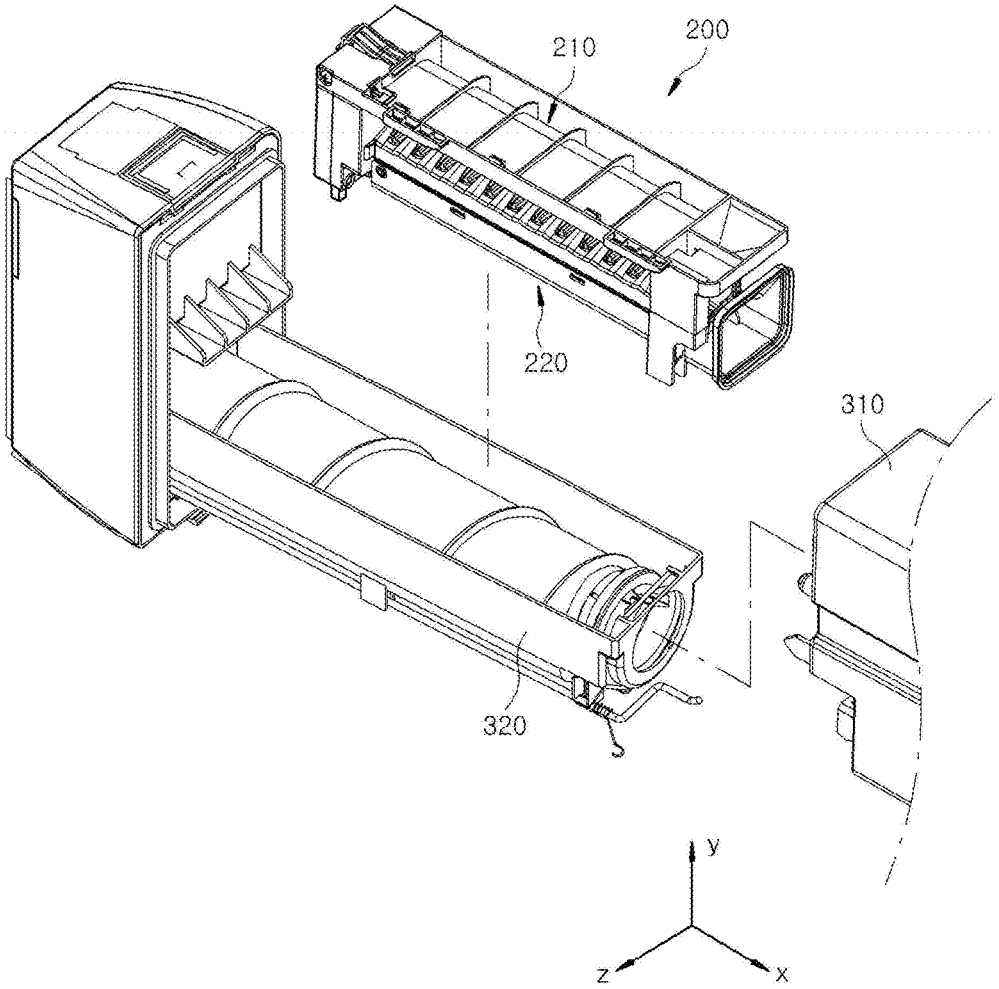
FIG. 3 is an exploded perspective view showing the ice maker of FIG. 1 according to an embodiment of the present invention.

FIG. 1 is a view illustrating a refrigerator unit including an ice maker 10, according to an embodiment of the present invention. FIG. 2 is a side cross-sectional view showing the ice maker 10 of FIG. 1, in accordance with one embodiment of the present disclosure. FIG. 3 is an exploded perspective view showing the ice maker 10 of FIG. 1, in accordance with one embodiment of the present disclosure.

Referring to FIGS. 1 to 3, an ice maker 10 of a refrigerator unit 1 may include a case 100, a cooling unit (not shown), an ice making assembly 200, and a bucket 320 of embodiments of the present invention.

More particularly, as shown in FIG. 1, the refrigerator unit 1 may include a main body 2 having therein a food storage space, and is configured for forming an external appearance or exterior. A barrier 4 is configured for dividing the food storage space defined in the interior cavity of the main body 2, used for storing food and drink contained therein, into a refrigeration chamber R at the top thereof, and a freezer chamber F at the bottom thereof. One or more doors may be configured to selectively isolate the interiors of the chambers from the surrounding environment. For example, refrigeration chamber doors 3 are provided at both front edges of the main body 2 and are configured through rotation thereof for selectively shielding the refrigeration chamber R. A freezer chamber door 5 is configured for shielding a front opening of the freezer chamber F.

In the present embodiment, although the ice maker 10 is shown as being provided at one side of an upper portion of the refrigeration chamber R, the location is provided merely for illustration purposes only. Alternatively, the ice maker 10 may be installed in a different position within the interior of refrigeration chamber R, or at a different position such as the refrigeration chamber door 3, and the like.

The case 100 has defined therein a cooling space 105, to which cold air generated by the cooling unit is supplied. The ice making assembly 200 may be arranged at an upper side and/or portion of the cooling space 105. The bucket 320 may be arranged at a lower side and/or portion of the ice making assembly 200.

The cooling unit generates cold air and supplies the generated cold air to the cooling space 105. The cooling unit may include a compressor, a condenser, an expansion valve, an evaporator, etc. which constitute a cooling and/or refrigeration cycle. For example, the cooling unit generates cold air by exchanging heat between a refrigerant and air. The cold air may be actively supplied to the ice tray 210 via a discharge duct 310 and a cold air guiding unit 220 by a blower, or the like.

The ice making assembly 200 includes an ice tray 210 which receives water, a cold air guiding unit 220 which guides the flow of cold air such that the cold air supplied from the cooling unit moves along a bottom surface of the ice tray 210, and a heater (not shown) which separates the ice made in the ice tray 210 from the ice tray 210.

The ice tray 210 provides a space in which water supplied from a water supply pipe (not shown), or the like, is cooled into ice. The ice tray 210 may have a plurality of ice making recesses 215 formed at an upper side or surface thereof for receiving water. The ice making recesses 215 may have various shapes according to the shape of ice that is intended to be made, and the number of the ice making recesses 215 may be variously adjusted.

The ice tray 210 may be made of metals having high thermal conductivity. For example, the ice tray 210 may be made from aluminum. The higher the thermal conductivity of the ice tray 210, the greater the heat exchange rate of the water and cold air, which uses less cooling cycles to make ice. Consequently, depending on the metal used, the ice tray 210 may serve as a type of heat exchanger. Further, although not shown, a cooling rib or the like may be installed at the bottom surface of the ice tray 210 to increase the area of contact with the cold air, also reducing the number of cooling cycles to make ice.

The cold air guiding unit 220 functions to guide the cold air supplied from the cooling unit to the bottom or lower side of the ice tray 210. The cold air guiding unit 220 may be connected to the discharge duct 310, which forms a passage through which the cold air circulates as it is being supplied from the cooling unit. The cold air guiding unit 220 may include guide members 221 and 222 that are each connected to at least one surface of the discharge duct 310. As shown, the cold air guiding unit 220 may include a first guide member 221 extending from an upper surface of the discharge duct 310, and a second guide member 222 extending from a lower surface of the discharge duct 310.

The first guide member 221 may be connected between the upper surface of the discharge duct 310 and a bracket 211 to which the ice tray 210 is mounted. The second guide member 222 may extend from the lower surface of the discharge duct 310, so as to be spaced apart from the bottom surface of the ice tray 210 by a predetermined distance. Thus, a cold air flow channel 225, configured for allowing the movement of cold air, may be formed between the bottom surface of the ice tray 210 and an upper surface of the second guide member 222.

The cold air guided by the guide members 221 and 222 may move towards and/or over the bottom surface of the ice tray 210. The cold air may exchange heat with the ice tray 210, such that the water contained in the ice making recesses 215 of the ice tray 210 may be frozen into ice.

The ice made in the above manner may be dropped into the bucket 320 arranged beneath the ice tray 210. For example, an additional rotation device may be provided such that the upper surface of the ice tray 210 may be turned towards the bucket 320 by rotation of the rotation device. Subsequently, the ice tray 210 may be twisted due to interference with a predetermined interference member (not shown) when the ice tray 210 is rotated more than a specific angle. The ice received in the ice tray 210 may be dropped into the bucket 320 through twisting of the ice tray 210. Alternatively, an ejector provided at the ice tray 210 may drop the ice made in the ice making recesses 215 into the bucket 320 without rotation of the ice tray 210.

Figure 4:
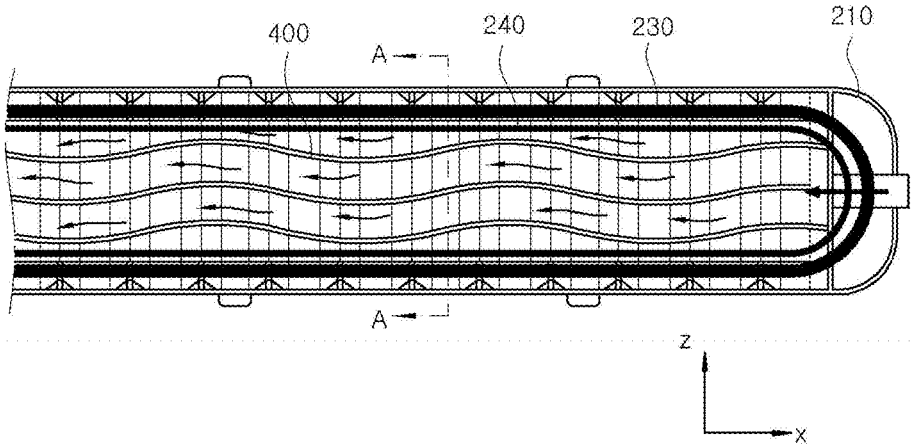
FIG. 4 is a bottom view showing an ice making assembly of the ice maker of FIG. 1 according to an embodiment of the present invention.
Figure 5:
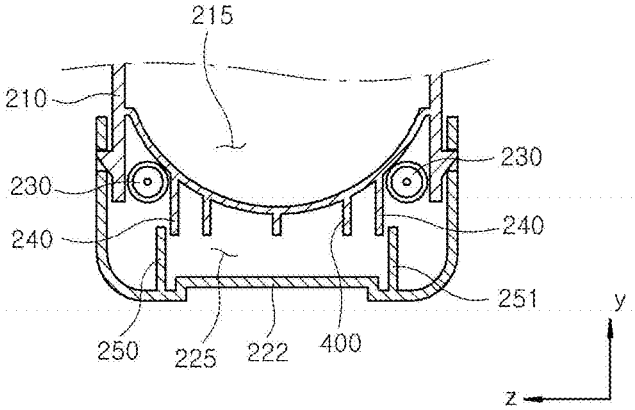
FIG. 5 is a cross-sectional view taken along line A-A of FIG. 4 according to an embodiment of the present invention.

The heater may emit heat to the ice tray 210 such that the ice formed in the ice making recesses 215 can be easily separated from the ice making recesses 215. That is, the heater may emit heat to slightly melt the ice formed in the ice tray 210. Thereafter, the ice tray 210 may be rotated, or the ejector may be driven, such that the ice is dropped into the bucket 320. As shown in FIGS. 4 and 5, the heater may be provided at the bottom surface of the ice tray 210, while extending along the edge of the ice tray 210.

Meanwhile, conventionally, the heat emitted by the heater comes across and/or interacts with the cold air generated by the cooling unit, whereby heat exchange between the heat and the cold air occurs. As a result, overall efficiency is considerably lowered. In embodiments of the present invention, however, the heater may be spatially separated from the cold air guiding unit 220. As a result, heat exchange between the heat emitted by the heater and the cold air generated by the cooling unit may be prevented.

Hereinafter, embodiments of the present invention will be described in more detail with reference to FIGS. 4 and 5. FIG. 4 is a bottom view showing the ice making assembly of the ice maker 10 of FIG. 1, in accordance with one embodiment of the present disclosure. FIG. 5 is a cross-sectional view taken along line A-A of FIG. 4. For clarity, the cold air guiding unit 220 is not shown in FIG. 4.

For reference, a longitudinal direction of the ice tray 210 may mean an x-axis direction in FIGS. 4 and 5, indicating a direction in which the cold air flows, or a direction in which a longer side of the ice tray 210 extends. In addition, a lateral direction of the ice tray 210 may mean a z-axis direction in FIGS. 4 and 5, or a direction in which a shorter side of the ice tray 210 extends. Meanwhile, a y-axis direction may mean a vertical direction in FIG. 5, with corresponding direction in FIG. 4.

As shown, the heater 230 may be formed in a long band. The heater 230 may be provided at a lower side and/or portion of the ice tray 210. More specifically, the heater 230 may be provided at the lower side of the ice tray 210, while extending along the edge of the ice tray 210.

A first heat exchange prevention wall 240 may protrude downward from the bottom surface of the ice tray 210, while extending along the edge of the ice tray 210. Consequently, the first heat exchange prevention wall 240 may have an arrangement structure similar to that of the heater 230. However, the first heat exchange prevention wall 240 may be located more inwardly in relation to the ice tray 210 than the heater 230. Consequently, the heater 230 may be located outside the first heat exchange prevention wall 240. Meanwhile, as shown in FIG. 5, the cold air flow channel 225 is defined between opposite sides of the first heat exchange prevention wall 240. That is, the cold air may flow to the inside of the first heat exchange prevention wall 240 away from heater 230. As a result, heat exchange between the cold air and the heat emitted by the heater 230 may be prevented.

In other words, the cold air may flow along a central portion of the ice tray 210 in the longitudinal direction of the ice tray 210. The heater 230 may extend along the edge of the ice tray 210. The first heat exchange prevention wall 240 may be located between the central portion and the edge of the ice tray 210, whereby heat exchange between the heat emitted by the heater 230 and the cold air in the cold air flow channel 225 may be prevented.

Referring to FIG. 5, the second guide member 222 is provided with a pair of second heat exchange prevention walls 250 and 251. The second heat exchange prevention walls 250 and 251 may protrude upward from the upper surface of the second guide member 222 while extending along the edge of the ice tray 210 in the longitudinal direction of the ice tray 210. Unlike the heater 230 and the first heat exchange prevention wall 240, ends of the second heat exchange prevention walls 250 and 251 are not connected to each other. As a result, cold air may be introduced between the second heat exchange prevention walls 250 and 251.

As shown in FIG. 5, the heater 230 may be located outside the second heat exchange prevention walls 250 and 251, away from the cold air flow channel 225. The cold air may be introduced between the second heat exchange prevention walls 250 and 251, as described above. Consequently, heat exchange between the cold air and the heat emitted by the heater 230 may be prevented.

In addition, at least a portion (the lower end in this embodiment) of the first heat exchange prevention wall 240 and at least a portion (the upper end in this embodiment) of the second heat exchange prevention wall 250 and/or 251 may overlap each other in the lateral direction of the ice tray 210. As a result, the effect of heat exchange prevention may be further improved.

Meanwhile, a plurality of cooling ribs 400 may be provided at the bottom surface of the ice tray 210 thereof. The cooling ribs 400 may protrude downward while extending in the longitudinal direction of the ice tray 210. The cooling ribs 400 may increase the contact area between the ice tray 210 and the cold air, thereby improving cooling efficiency. The cooling ribs 400 may be spaced apart from each other in the lateral direction of the ice tray 210. Consequently, the cold air may flow between the respective cooling ribs 400.

Conventionally, the cooling ribs extend straight in the longitudinal direction of the ice tray. In one embodiment of the present invention, however, each of the cooling ribs 400 may have at least one curved section as shown in FIG. 4. As compared with the conventional structure, therefore, the contact area between the tray 210 and the cold air may be increased. As such, the cold air may stay on the bottom surface of the ice tray 210 for a longer period of time, as when compared to the conventional art, thereby improving cooling efficiency.

Figure 6:
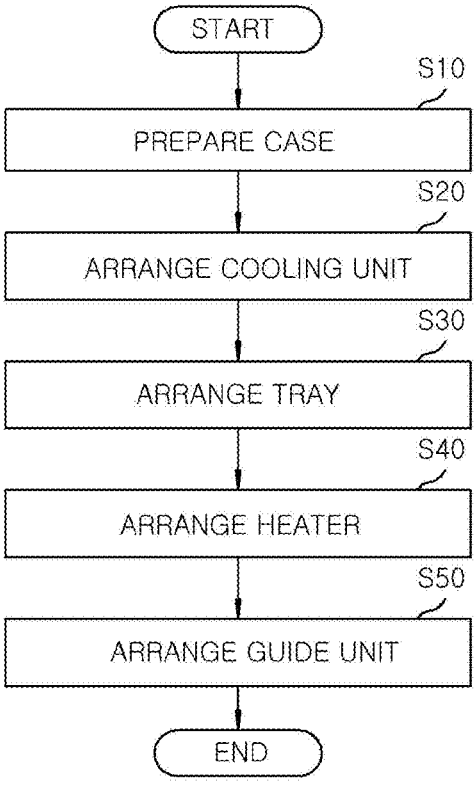
FIG. 6 is a flow diagram illustrating a method of manufacturing an ice maker according to an embodiment of the present invention.

FIG. 6 is a flow diagram illustrating a method of manufacturing the ice maker according to an embodiment of the present invention. The structures and features of the components of the ice maker 10 as described above in FIGS. 1-5 will now be described in relation to the flow diagram of FIG. 6.

First, the case 100 may be prepared (S10). The cooling unit, including the compressor, the condenser, the expansion valve, and the evaporator, which generates cold air, may be arranged at one side of the refrigerator unit 1 (S20). The ice tray 210, which includes the ice making recesses 215 formed in the upper surface thereof for making ice, may be arranged in the case 100 (S30). The heater 230 may be arranged at the lower side of the ice tray 210 (S40). Subsequently, the cold air guiding unit 220, which guides the cold air generated by the cooling unit to the lower side of the ice tray 210, may also be arranged in the case 100 (S50). As previously described, the cold air guiding unit 220 and the heater 230 may be spatially separated from each other.

As is apparent from the above description, in accordance with exemplary embodiments of the present invention, it may be possible to provide an ice maker of a refrigerator unit that is capable of preventing heat exchange between heat emitted by a heater and cold air, thereby improving overall efficiency, and a manufacturing method of the same.

In addition, it may be possible to provide an ice maker of a refrigerator unit including cooling ribs, the shape, structure, arrangement, etc. of which are designed to improve cooling efficiency, and a manufacturing method of the same.

Although the preferred embodiments of the present invention have been disclosed for illustrative purposes, it will be apparent to those skilled in the art that various changes and modifications may be made without departing from the spirit and scope of the invention as defined in the following claims.

The foregoing description, for purpose of explanation, has been described with reference to specific embodiments of an ice maker and a method for the same. However, the illustrative discussions above are not intended to be exhaustive or to limit the invention to the precise forms disclosed. It should be construed that the present invention has the widest range in compliance with the basic idea disclosed in the invention. Many modifications and variations are possible in view of the above teachings. Although it is possible for those skilled in the art to combine and substitute the disclosed embodiments to embody the other types that are not specifically disclosed in the invention, they do not depart from the scope of the present invention as well. The embodiments were chosen and described in order to best explain the principles of the invention and its practical applications, to thereby enable others skilled in the art to best utilize the invention. Further, it will be understood by those skilled in the art that various changes and modifications may be made without departing from the scope of the invention as defined in the following claims.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed.

The various example methods described and/or illustrated herein may also omit one or more of the steps described or illustrated herein or include additional steps in addition to those disclosed.

Embodiments according to the invention are thus described. While the present disclosure has been described in particular embodiments, it should be appreciated that the invention should not be construed as limited by such embodiments.

What is claimed is:

1. An ice maker of a refrigerator, comprising:

a cooling unit configured for generating cold air;

a case mounted in a food storage space of the refrigerator or a door for shielding the food storage space, the case having defined therein a cooling space for receiving the cold air generated by the cooling unit;

an ice making assembly arranged at an upper side in the cooling space and for making ice; and a bucket arranged at a lower side of the ice making assembly for receiving the ice separated from the ice making assembly, wherein the ice making assembly comprises:

an ice tray arranged in the cooling space, the ice tray having an ice making recess formed in an upper surface thereof for making ice;

a cold air guiding unit arranged at a lower side of the ice tray for guiding the cold air supplied from the cooling unit to the lower side of the ice tray, and a heater provided at the lower side of the ice tray to extend along a periphery of the ice tray and configured to be spatially separated from the cold air guiding unit, and wherein the heater emits heat to separate the ice from the ice making recess;

wherein the cold air guiding unit comprises a guide member spaced apart downward from the bottom surface of the ice tray for defining a cold air flow channel, along which the cold air flows, between the guide member and the bottom surface of the ice tray, wherein the ice maker further comprises a first heat exchange prevention wall protruding downward from the bottom surface of the ice tray while extending along an entire periphery of the heater, and a pair of second heat exchange prevention walls protruding upward from an upper surface of the guide member while respectively extending along longitudinal sides of the first heat exchange prevention wall such that the second heat exchange prevention walls are spaced apart from each other in a lateral direction of the ice tray while the second heat exchange prevention walls are overlapped with the first heat exchange prevention wall in the lateral direction of the ice tray at entire portions of the longitudinal sides of the first heat exchange prevention wall, and wherein the heater is positioned outside of the first heat exchange prevention wall and the second heat exchange prevention walls to prevent heat exchange between the heat emitted by the heater and the cold air flowing in the cold air flow channel, which is formed in and surrounded by the first heat exchange prevention wall and the second heat exchange prevention walls.

2. The ice maker according to claim 1, further comprising:

a plurality of cooling ribs protruding downward from a bottom surface of the ice tray while extending in a longitudinal direction of the ice tray, wherein at least one of the cooling ribs comprises at least one curved section, and wherein the cooling ribs being spaced apart from each other.

3. The ice maker according to claim 1, wherein the refrigerator comprises:

a freezer compartment located within a main body of the refrigerator;

a refrigeration compartment located within the main body of the refrigerator, wherein the freezer compartment is located below the refrigeration compartment; and the ice maker.

4. The ice maker according to claim 1, wherein the ice tray is indirectly cooled by the cold air flowing through the cold air flow channel.

5. A method of manufacturing an ice maker of a refrigerator, comprising:

preparing a case;

arranging a cooling unit configured for generating cold air;

arranging an ice tray having an ice making recess formed in an upper surface thereof for making ice;

arranging a heater at a lower side of the ice tray to extend along a periphery of the ice tray;

arranging a cold air guiding unit for guiding the cold air generated by the cooling unit to a lower side of the ice tray, wherein the cold air guiding unit includes a guide member spaced apart downward from the bottom surface of the ice tray for defining a cold air flow channel, along which the cold air flows, between the guide member and the bottom surface of the ice tray, and wherein the cold air guiding unit and the heater are spatially separated from each other at the lower side of the ice tray;

arranging a first heat exchange prevention wall protruding downward from the bottom surface of the ice tray while extending along an entire periphery of the heater, and, arranging a pair of second heat exchange prevention walls protruding upward from an upper surface of the guide member while respectively extending along longitudinal sides of the first heat exchange prevention wall such that the second heat exchange prevention walls are spaced apart from each other in a lateral direction of the ice tray while the second heat exchange prevention walls are overlapped with the first heat exchange prevention wall in the lateral direction of the ice tray at entire portions of the longitudinal sides of the first heat exchange prevention wall, wherein the heater is positioned outside of the first heat exchange prevention wall and the second heat exchange prevention walls to prevent heat exchange between heat emitted by the heater and the cold air flowing in the cold air flow channel, which is formed in and surrounded by the first heat exchange prevention wall and the second heat exchange prevention walls.

6. The method according to claim 5, wherein the ice tray is indirectly cooled by the cold air flowing through the cold air flow channel.

* * * * *